US008851471B2

(12) United States Patent
Yamazaki

(10) Patent No.: US 8,851,471 B2
(45) Date of Patent: Oct. 7, 2014

(54) IMAGE FORMING APPARATUS AND SHEET ADJUSTING DEVICE INCORPORATED THEREIN

(71) Applicant: Tomoyoshi Yamazaki, Tokyo (JP)

(72) Inventor: Tomoyoshi Yamazaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/904,334

(22) Filed: May 29, 2013

(65) Prior Publication Data

US 2013/0334769 A1 Dec. 19, 2013

(30) Foreign Application Priority Data

Jun. 13, 2012 (JP) ..... 2012-133403

(51) Int. Cl.

| | |
|---|---|
| ***B65H 9/16*** | (2006.01) |
| ***B65H 9/04*** | (2006.01) |
| ***B65H 7/02*** | (2006.01) |
| ***B65H 9/10*** | (2006.01) |

(52) U.S. Cl.

CPC ..... *B65H 9/103* (2013.01); *B65H 9/106* (2013.01); *B65H 2220/15* (2013.01); *B65H 2301/3611* (2013.01); *B65H 2301/3613* (2013.01); *B65H 2301/36212* (2013.01)

USPC ..... 271/252; 271/228; 271/253

(58) Field of Classification Search

CPC .... B65H 9/103; B65H 9/106; B65H 2220/15; B65H 2301/3611; B65H 2301/3613; B65H 2301/36212; B65H 7/10

USPC ..... 271/253, 249, 242, 228

See application file for complete search history.

(56) References Cited

U.S. PATENT DOCUMENTS

| | | | | |
|---|---|---|---|---|
| 5,335,904 | A * | 8/1994 | Ryuzaki | 271/272 |
| 7,527,263 | B2 * | 5/2009 | DeGruchy et al. | 271/242 |
| 7,753,370 | B2 * | 7/2010 | Inoue | 271/239 |
| 7,857,308 | B2 * | 12/2010 | Nakazawa et al. | 271/252 |
| 2006/0208416 | A1 * | 9/2006 | Dejong et al. | 271/228 |
| 2007/0284810 | A1 * | 12/2007 | Nakazawa et al. | 271/228 |
| 2008/0024808 | A1 | 1/2008 | Masuda | |
| 2008/0054553 | A1 | 3/2008 | Muneyasu et al. | |
| 2008/0232866 | A1 | 9/2008 | Shoji et al. | |
| 2008/0240821 | A1 | 10/2008 | Shoji et al. | |
| 2008/0251998 | A1 | 10/2008 | Muneyasu et al. | |
| 2008/0296828 | A1 | 12/2008 | Shoji et al. | |

FOREIGN PATENT DOCUMENTS

| | | |
|---|---|---|
| JP | 8-108956 | 4/1996 |
| JP | 2004-018194 | 1/2004 |
| JP | 2007-106572 | 4/2007 |
| JP | 2007-153506 | 6/2007 |
| JP | 2008-230832 | 10/2008 |
| JP | 2012-062172 | 3/2012 |

* cited by examiner

*Primary Examiner* — Patrick Cicchino

(74) *Attorney, Agent, or Firm* — Harness, Dickey & Pierce, P.L.C.

(57) ABSTRACT

An image forming apparatus includes an image forming device and a sheet adjusting device to adjust a lateral position of the sheet by moving a sheet in a lateral direction perpendicular to a sheet conveyance direction. The sheet adjusting device moves a driving roller in one of a first direction and a second direction for adjusting a lateral position of the sheet between the driving roller and a driven roller and then adjusting a lateral position of the driven roller to the driving roller by moving the driving roller in the second direction until the misaligned driven roller laterally contacts respective stoppers to restrict a range of lateral movement of the driven roller while the sheet is separated from the driving roller and the driven roller and by further moving the driving roller to a predetermined position while the driven roller remains contacting the stoppers.

12 Claims, 9 Drawing Sheets

IMAGE FORMING APPARATUS AND SHEET ADJUSTING DEVICE INCORPORATED THEREIN

CROSS-REFERENCE TO RELATED APPLICATIONS

This patent application is based on and claims priority pursuant to 35 U.S.C. §119 to Japanese Patent Application No. 2012-133403, filed on Jun. 13, 2012 in the Japan Patent Office, the entire disclosure of which is hereby incorporated by reference herein.

BACKGROUND

1. Technical Field

Embodiments of the present invention relate to an image forming apparatus such as a copier, printer, facsimile machine, a multifunctional machine having at least two functions of the copier, printer, and facsimile machine, and so forth, and a sheet adjusting device included in the image forming apparatus to adjust a position of a recording medium (i.e., a sheet) in a lateral direction perpendicular to a sheet conveyance direction, by moving the recording medium laterally.

2. Related Art

Japanese Patent Nos. JP-4614243-B2 (JP-2008-230832-A) and JP-3268329-B2 (JP-H08-108956-A) disclose image forming apparatuses employing a technique using a sheet adjusting device that can correct or adjust the position of a misaligned sheet in a lateral direction perpendicular to a sheet conveyance direction while the sheet is held between sheet conveyance rollers.

Such sheet adjusting devices generally include a moving mechanism in which a first moving unit moves a driving roller laterally and a second moving unit moves a driven roller laterally.

However, this addition of the moving mechanism to the sheet adjusting device has caused an increase in both size and cost of the image forming apparatus. The moving mechanism can be configured with a single moving unit that rotates the driving roller. In that case, however, the driven roller itself is fixed to the housing of the image forming apparatus, which restricts its movement laterally. Under this condition, when the sheet that is held between the driving roller and the driven roller is shifted laterally together with the driving roller of the moving mechanism, the fixed driven roller may prevent the sheet from moving to a target position due to sliding friction between the sheet and the driven roller.

By contrast, if the driven roller is allowed to rotate laterally with the driving roller due to the frictional resistance, the sheet held between the driving roller and the driven roller can be shifted together with the driving roller of the moving mechanism to the target position laterally.

However, when correcting the position of a sheet having low surface frictional resistance, the driven roller may not move the same amount as the sheet, which can cause misalignment of the sheet laterally due to low sliding friction with the sheet. As the image forming apparatus repeats this action, the position of the driven roller relative to the driving roller gradually shifts laterally, creating a large gap between the driving roller and the driven roller and separation from the sheet therebetween.

SUMMARY

The present invention provides a novel image forming apparatus including an image forming device to form an image on a surface of a sheet of recording media, a sheet adjusting device to an image forming device to form an image on a surface of a sheet of recording media and a sheet adjusting device to adjust a lateral position of the sheet by moving the sheet in a lateral direction perpendicular to a sheet conveyance direction, and a controller. The sheet adjusting device includes a driving unit driven by the controller, a moving unit connected to the driving unit, a driving roller rotatable by the driving unit and movable laterally by the moving unit, a driven roller rotatable with rotation of the driving roller while pressing and holding the sheet with the driving roller and movable laterally with movement of the driving roller, and stoppers disposed contactable with both end portions of the driven roller to restrict a range of movement of the driven roller laterally. The controller causes the moving unit to move the driving roller in one of a first direction toward one axial end of the driving roller and a second direction toward the other axial end of the driving roller for adjusting a position of the sheet interposed between the driving roller and the driven roller laterally, and then adjusting the lateral position of the driven roller with respect to the driving roller by moving the driving roller in a second direction that is opposite to the first direction until the driven roller in misregistration with respect to the driving roller laterally contacts the stoppers with the sheet separated from the driving roller and the driven roller and then by moving the driving roller in the second direction to a predetermined position with the driven roller remaining in contact with the stoppers.

Further, the present invention provides a novel sheet adjusting device including a driving unit, a moving unit connected to the driving unit, a driving roller rotatable by the driving unit and movable laterally by the moving unit, a driven roller rotatable with rotation of the driving roller while pressing and holding the sheet with the driving roller and movable laterally with movement of the driving roller, stoppers disposed contactable with both end portions of the driven roller to restrict a range of movement of the driven roller laterally, and a controller to drive the driving unit. The controller causes the moving unit to move the driving roller in one of a first direction toward one axial end of the driving roller and a second direction toward the other axial end of the driving roller for adjusting a position of the sheet interposed between the driving roller and the driven roller laterally, and then adjusting the lateral position of the driven roller with respect to the driving roller by moving the driving roller in a second direction that is opposite to the first direction until the driven roller in misregistration with respect to the driving roller laterally contacts the stoppers with the sheet separated from the driving roller and the driven roller and then by moving the driving roller in the second direction to a predetermined position with the driven roller remaining in contact with the stoppers.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
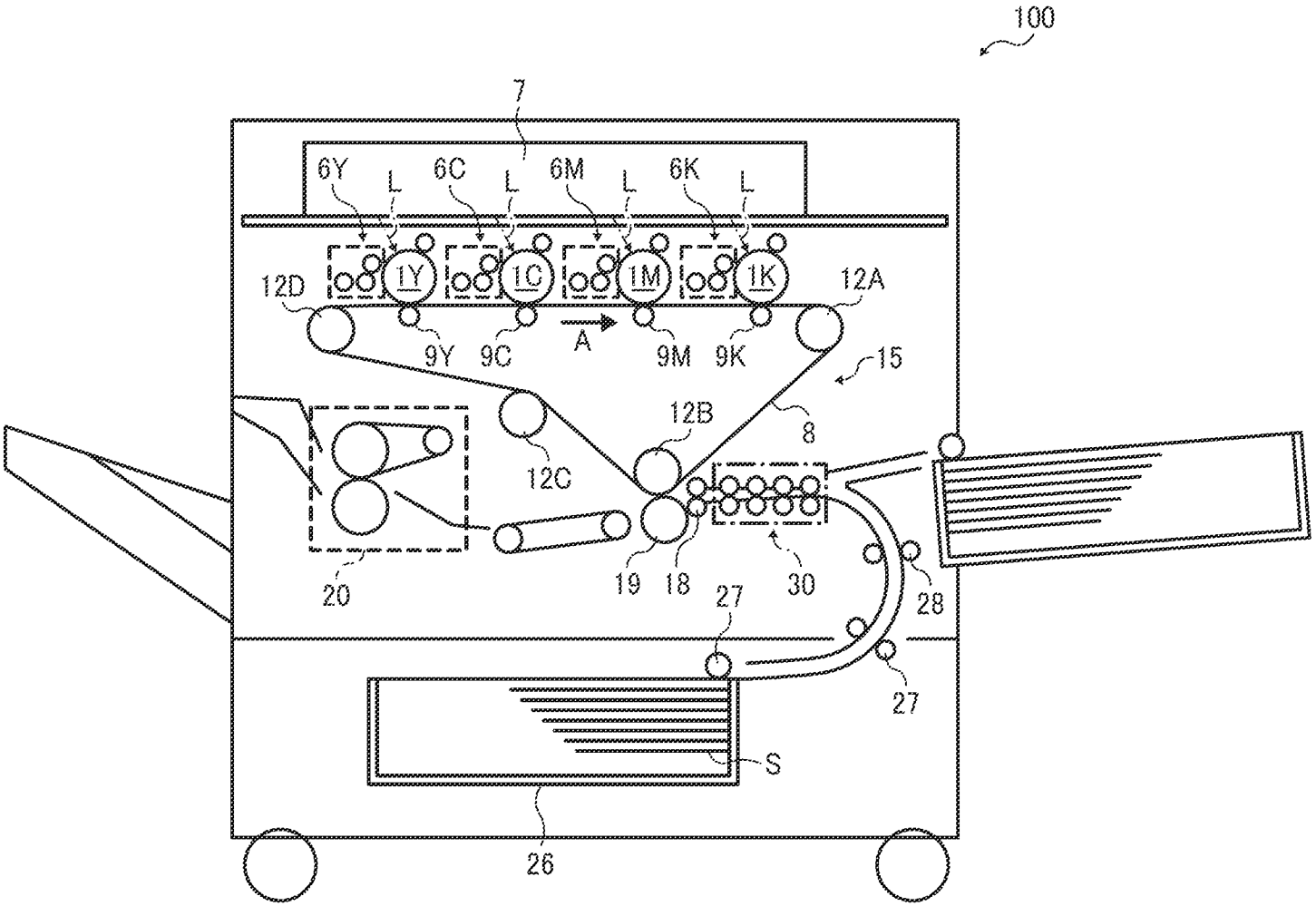
FIG. 1 is a diagram illustrating a schematic configuration of an overall image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Figure 2:
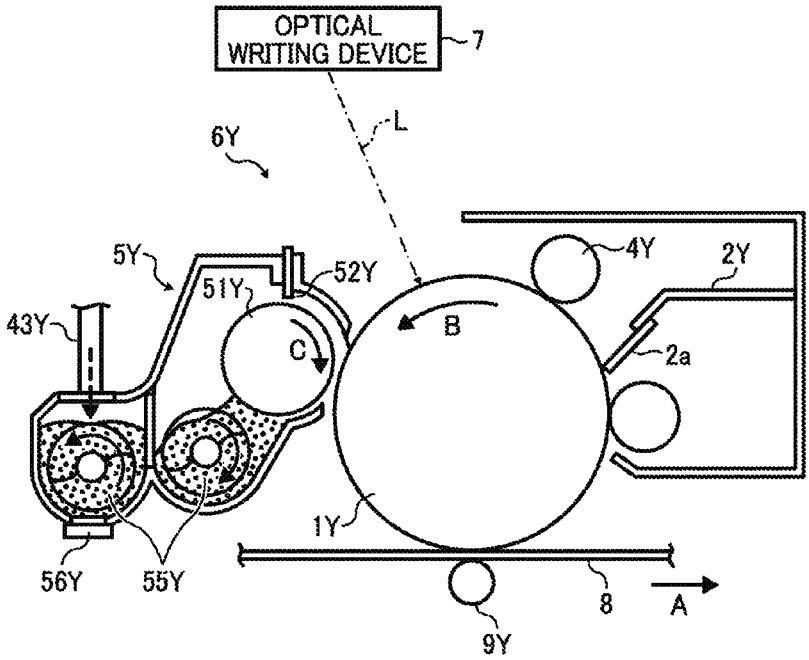
FIG. 2 is a cross-sectional view illustrating an image forming device included in the image forming apparatus of FIG. 1.

Referring to FIGS. 1 and 2, descriptions are given of an image forming apparatus according to an embodiment of the present invention. FIG. 1 is a diagram illustrating a schematic configuration of an overall image forming apparatus (e.g., a printer) 100 according to an embodiment of the present invention. FIG. 2 is a cross-sectional, enlarged view illustrating an image forming device included in the image forming apparatus of FIG. 1.

As illustrated in FIG. 1, the image forming apparatus 100 includes an intermediate transfer belt device 15, image forming devices 6Y, 6M, 6C, and 6K, a pair of registration rollers 18, an exposure device 7, and a sheet adjusting device 30.

The intermediate transfer belt device 15 is disposed at the center portion of the image forming apparatus 100 and includes an intermediate transfer belt 8.

The image forming devices 6Y, 6M, 6C, and 6K forming yellow, magenta, cyan, and black images, respectively, are aligned facing the intermediate transfer belt 8 of the intermediate transfer belt device 15.

The pair of registration rollers 18 is disposed below the right side of the intermediate transfer belt unit 15 and functions as timing rollers.

The exposure device 7 exposes an image carrier for forming an electrostatic latent image on a surface thereof.

The sheet adjusting device 30 that is a sheet conveyance and positioning device is also disposed below the right side of the intermediate transfer belt unit 15 and is upstream from the pair of registration rollers 18 in the sheet conveyance direction.

As illustrated in FIG. 2, the image forming device 6Y for forming a yellow image includes a photoconductor drum 1Y that functions as an image carrier and image forming units disposed surrounding the photoconductor drum 1Y. As examples of the image forming units, a charger 4Y uniformly charges the surface of the photoconductor drum 1Y, a development unit 5Y supplies toner for forming a toner image, a cleaning unit 2Y cleans the surface of the photoconductor drum 1Y, and an electric discharging unit (not illustrated) removes electrical charge from the surface of the photoconductor drum 1Y. These units perform image forming processes such as a charging process, an exposing process, a developing process, a transferring process, and a cleaning process with respect to the photoconductor drum 1Y for forming a yellow toner image.

The image forming devices 6M, 6C, and 6K have the same configuration and operations as the image forming device 6Y except for the colors of toners. It is to be noted that the following description generally given of the functions and operations performed by the image forming device 6Y can be applied to the functions and operations performed by the image forming devices 6M, 6C, and 6K.

In the charging process, the photoconductor drum 1Y is driven by a driving motor (not illustrated) to rotate in counterclockwise B in FIG. 2 and the surface thereof is uniformly charged at the charger 4Y. Then, in the exposing process, the surface of the photoconductor drum 1Y passes an area where the exposure device 7 emits a laser light beam L to expose the surface of the photoconductor drum 1Y so that an electrostatic latent image for yellow color is formed thereon.

In the developing process, the surface of the photoconductor drum 1Y then faces the development unit 5Y, where the electrostatic latent image formed on the surface of the photoconductor drum 1Y is developed into a yellow toner image.

The surface of the photoconductor drum 1Y continues to rotate and faces the intermediate transfer belt 8 and a transfer roller 9Y, where the toner image formed on the surface of the photoconductor drum 1Y is transferred onto the intermediate transfer belt 8 in the transferring process. Transfer of the toner image leaves residual toner on the surface of the photoconductor drum 1Y.

When the surface of the photoconductor drum 1Y reaches an opposed position to the cleaning unit 2Y, the residual toner remaining on the surface of the photoconductor drum 1Y is removed by a cleaning blade 2*a* and collected to the cleaning unit 2Y in the cleaning process.

Finally, the surface of the photoconductor drum 1Y faces an electric discharging unit so that residual electric charge is removed from the photoconductor drum 1Y.

Thus, a series of image forming processes on the photoconductor drum 1Y completes.

The above-described image forming processes are also conducted in the image forming devices 6M, 6C, and 6K. Specifically, the exposure device 7 disposed above the image forming devices 6M, 6C, and 6K emits and scans laser light beams L based on image data using a rotating polygon minor to irradiate the scanned laser light beams L to the photoconductor drums 1M, 1C, and 1K of the image forming devices 6M, 6C, and 6K. After the developing process has been conducted, the toner images of different colors formed on the photoconductor drums 1M, 1C, and 1K are sequentially transferred onto the surface of the intermediate transfer belt 8 functioning as a belt-type image carrier. Thus, a composite color toner image is formed on the surface of the intermediate transfer belt 8.

Figure 3:
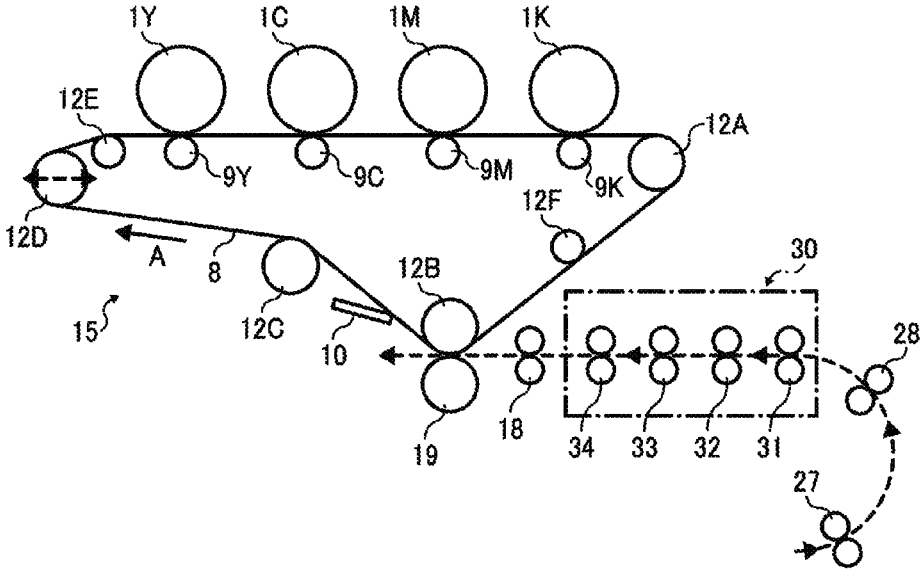
FIG. 3 is a schematic view illustrating a sheet adjusting device incorporated in the image forming apparatus of FIG. 1 and units in the vicinity thereof.

Referring to FIG. 3, a description is given of a configuration of the intermediate transfer belt unit 15.

The intermediate transfer belt unit 15 includes the intermediate transfer belt 8, four transfer rollers 9Y, 9M, 9C, and 9K, a driving roller 12A, an opposed roller 12B functioning as a driven roller, tensioning rollers 12C through 12F, an intermediate transfer cleaning unit 10, and so forth.

The intermediate transfer belt 8 is supported and stretched taut by multiple rollers 12A through 12F and endlessly rotated by a driving roller 12A in a direction indicated by arrow A in FIG. 3.

The four transfer rollers 9Y, 9M, 9C, and 9K face and contact the photoconductor drums 1Y, 1M, 1C, and 1K, respectively, interposing the intermediate transfer belt 8 therebetween, where respective primary transfer nip areas are formed. A transfer bias voltage that is opposite to the toner polarity is applied to the transfer rollers 9Y, 9M, 9C, and 9K.

As moving along the direction A, the intermediate transfer belt 8 functioning as a belt-type image carrier sequentially passes the primary transfer nip areas of the transfer rollers 9Y, 9M, 9C, and 9K. Thus, toner images having different toner colors formed on the photoconductor drums 1Y, 1M, 1C, and 1K are primarily transferred sequentially onto the intermediate transfer belt 8.

Then, the intermediate transfer belt 8 on which the composite toner image is formed reaches an opposed position of a secondary transfer roller 19. At this position, the opposed roller 12B faces and contacts the secondary transfer roller 19, interposing the intermediate transfer belt 8 therebetween, where respective a secondary transfer nip area is formed. The composite toner image formed on the surface of the intermediate transfer belt 8 is transferred onto a sheet S functioning as a recording medium that is conveyed to the secondary transfer nip area, in a secondary transfer process. Transfer of the composite toner image leaves residual toner on the surface of the intermediate transfer belt 8.

When the surface of the intermediate transfer belt 8 reaches an opposed position to the intermediate transfer cleaning unit 10, the residual toner remaining on the surface of the intermediate transfer belt 8 is removed.

Thus, a series of transfer processes on the intermediate transfer belt 8 completes.

In reference to FIGS. 1 and 3, the sheet S that functions as a recording medium is conveyed from a sheet tray 26 disposed at a lower part of the image forming apparatus 100 (or a sheet tray disposed on a side of the image forming apparatus 100) functioning as a sheet container to the secondary transfer nip area via a sheet feed roller 27, a sheet conveyance roller 28, a sheet adjusting device 30, a pair of registration rollers 18 and so forth. Specifically, the sheet tray 26 accommodates a stack of sheets such as recording media. Upon rotation of the sheet feed roller 27 in the counterclockwise direction in FIG. 1, an uppermost sheet is fed to the sheet adjusting device 30.

The uppermost sheet conveyed to the sheet adjusting device 30 is aligned or positioned correctly in a lateral direction (which is hereinafter referred to as a lateral registration adjustment) and conveyed to the pair of registration rollers 18. The uppermost sheet at the pair of registration rollers 18 is then conveyed by the pair of registration rollers 18 to the secondary transfer nip area at the same timing as that the color toner image formed on the surface of the intermediate transfer belt 8 is transferred, thereby transferring the color toner image onto the uppermost sheet. Detailed configuration and functions of the sheet adjusting device 30 are explained later, referring to FIGS. 3 through 12.

After having received the composite color toner image at the secondary transfer nip area, the uppermost sheet is conveyed to a fixing unit 20, where the composite color toner image is fixed to the surface of the uppermost sheet due to application of heat and pressure by a fixing roller and a pressure roller.

Then the uppermost sheet is discharged by a pair of sheet discharging rollers (not illustrated) to outside of the image forming apparatus 100. The following sheets S having a fixed image thereon are output to a sheet stacker sequentially.

FIG. 2 shows detailed configuration and operations of the development unit 5Y of the image forming device 6Y.

The development unit 5Y includes a development roller 51Y, a doctor blade 52Y, two conveyance screws 55Y, a toner feed path 43Y, and a toner concentration detector 56Y.

The development roller 51Y is disposed facing the photoconductor drum 1Y and includes a magnet roller fixedly disposed therein, a sleeve that rotates around the magnet roller, and so forth. The doctor blade 52Y is disposed facing the development roller 51Y. The two conveyance screws 55Y are included in a non-illustrated developer container that contains two-component developer including carrier and toner. The toner feed path 43Y communicates with the developer container via an opening (not illustrated). The toner concentration detector 56Y detects toner concentration in developer.

The development unit 5Y having the above-described configuration operates as follows.

The sleeve of the development roller 51Y rotates in a direction as indicated by arrow C in FIG. 2. Developer held on the development roller 51Y due to a magnetic field generated by the magnet roller moves on the development roller 51Y with rotation of the sleeve. Due to this movement, the percentage of toner (toner concentration) of the developer in the development unit 5Y is adjusted to settle within a predetermined range.

Then, while being mixed and agitated with the developer by the two conveyance screws 55Y, the toner supplied in the developer container circulates in partitioned two developer containers in a direction perpendicular to the drawing sheet of FIG. 2. Due to frictional charging with carriers in the developer, the toner adheres to the carriers and the toner and carriers are held on the development roller 51Y due to the magnetic force generated thereon.

The developer held on the development roller 51Y is conveyed in the direction C in FIG. 2 to reach the doctor blade 52Y, where the amount of developer is adjusted to a predetermined appropriate amount. The developer is then conveyed to a development area where the development roller 51Y faces the photoconductor drum 1Y. Due to an electric field generated in the development area, the toner is attracted to the electrostatic latent image formed on the surface of the photoconductor drum 1Y. Thereafter, as the sleeve rotates, the developer remaining on the surface of the development roller 51Y reaches an upper portion of the developer container, where the residual developer is removed therefrom.

Next, a description is given of a configuration and functions of the sheet adjusting device 30 according to an embodiment of the present invention, with reference to FIGS. 3 through 13A-13C.

The sheet adjusting device 30 according to this embodiment functions as a sheet conveying device and includes multiple pair of sheet feed rollers to convey the sheet S by interposing the sheet therebetween and to move in a lateral direction to correctly position the sheet S laterally. It is to be noted that "lateral direction" is defined as a direction perpendicular to a sheet conveyance direction and that "laterally" is defined as a state that a sheet or other members move in the lateral direction.

Specifically, with reference to FIGS. 3 through 7, the sheet adjusting device 30 includes four pairs of sheet feed rollers 31 through 34, an upper guide plate 35, a lower guide plate 36, an edge position detector unit 60, two shift blocks 41, two moving motors 45 and so forth.

Figure 4:
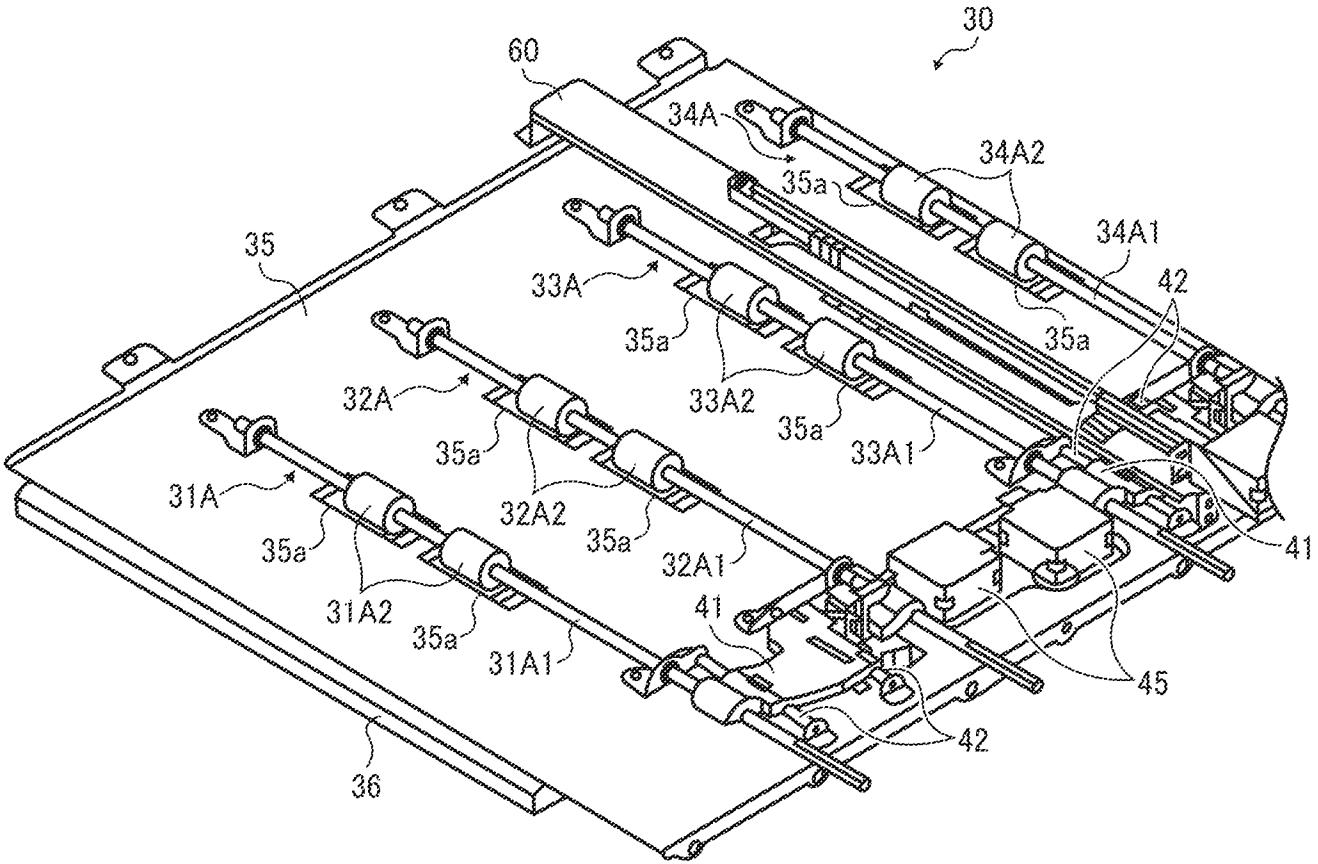
FIG. 4 is a perspective top view illustrating a configuration of the sheet adjusting device.

As illustrated in FIG. 4, each of the driving rollers 31A through 34A is a shaft and two rollers disposed at predetermined positions along the shaft. Specifically, the driving roller 31A includes a shaft 31A1 and rollers 31A2, the driving roller 32A includes a shaft 32A1 and rollers 32A2, the driving roller 33A includes a shaft 33A1 and rollers 33A2, and the driving roller 34A includes a shaft 34A1 and rollers 34A2. The respective driving rollers 31A through 34A are rotatably supported on the upper guide plate 35 at both ends laterally (i.e., the shaft direction, the main scanning direction) and are rotated by a driving unit serving as a driving mechanism in a clockwise direction of FIG. 3. Further, the respective driving rollers 31A through 34A are movable laterally when positioning the sheet S or the driven rollers 31B through 34B in the lateral registration adjustment.

Figure 5:
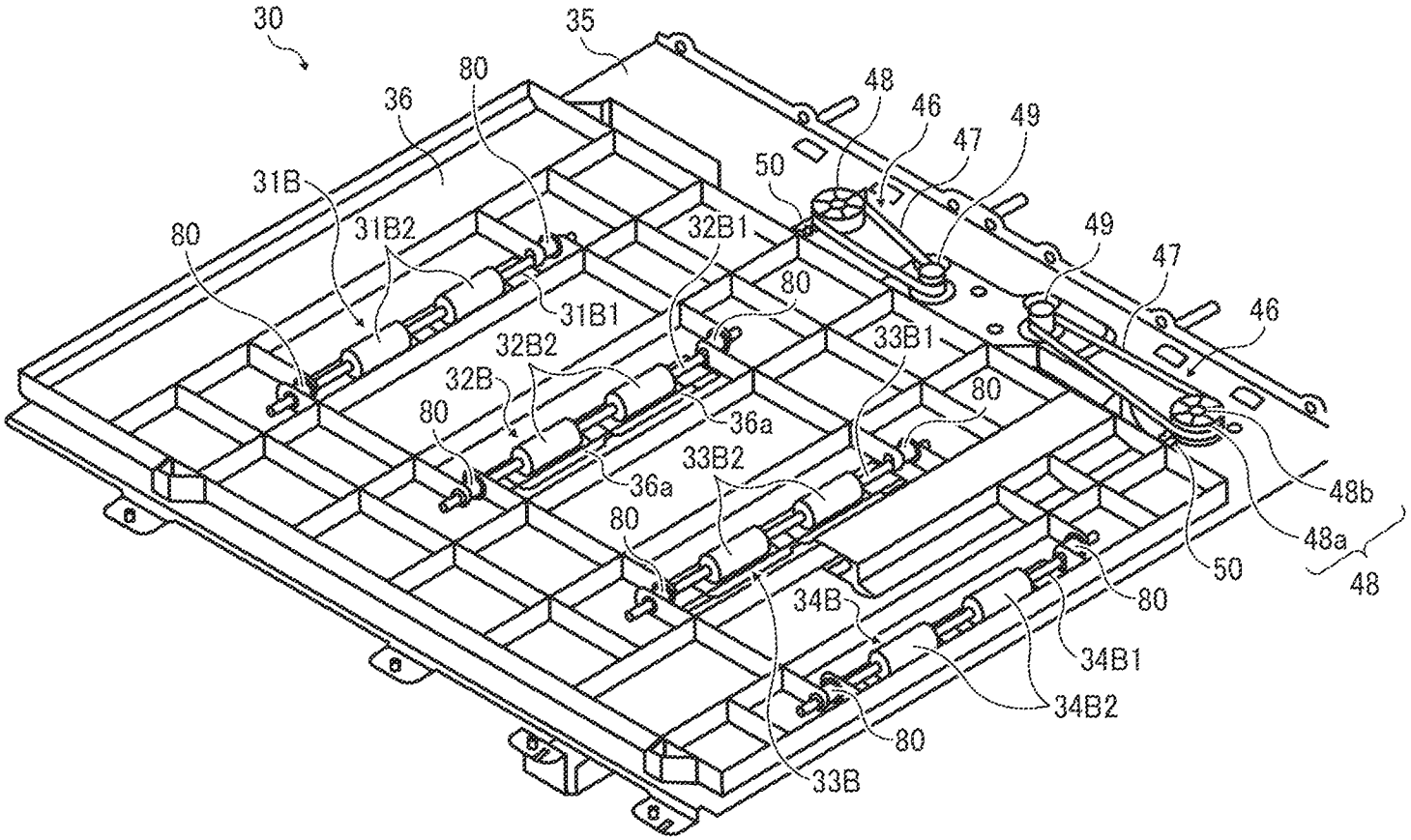
FIG. 5 is a perspective bottom view illustrating a configuration of the sheet adjusting device.

The upper guide plate 35 guides the sheet S and includes slots 35*a* so that the rollers 31A2 through 34A2 of the driving rollers 31A through 34A can contact rollers 31B2 through 34B2 of the driven rollers 31B through 34B (see FIGS. 4 and 5).

As illustrated in FIG. 5, as with the drive rollers 31A through 34A, the driven rollers 31B through 34B are constructed of a shaft and two rollers disposed at predetermined positions along the shaft. Specifically, the driven roller 31B includes a shaft 31B1 and rollers 31B2, the driven roller 32B includes a shaft 32B1 and rollers 32B2, the driven roller 33B includes a shaft 33B1 and rollers 33B2, and the driven roller 34B includes a shaft 34B1 and rollers 34B2. The respective driven rollers 31B through 34B are rotatably supported by bearings 80 on the lower guide plate 36 at both ends thereof. The bearings 80 are biased toward the driving rollers 31A through 34A via respective springs (not illustrated). Further, the respective driving rollers 31A through 34A are movable by moving units 41, 42, 45 through 50 laterally when positioning the sheet S or the driven rollers 31B through 34B in the lateral registration adjustment.

The lower guide plate 36 guides the sheet S and includes slots 36*a* so that the rollers 31B2 through 34B2 of the driven rollers 31B through 34B can contact rollers 31A2 through 34A2 of the driving rollers 31A through 34A (see FIGS. 4 and 5).

With the above-described configuration, the rollers 31B2 through 34B2 of the driven rollers 31B through 34B contact with pressure the rollers 31A2 through 34A2 of the driving rollers 31A through 34A, respectively, and the sheet S is interposed therebetween.

Further, due to frictional resistance with the driving rollers 31A through 34A not directly connected to the driving unit, the driven rollers 31B through 34B rotate in counterclockwise along with rotation of the driving rollers 31A through 34A.

Furthermore, due to frictional resistance with the driving rollers 31A through 34A not directly connected to the multiple moving units, the driven rollers 31B through 34B also rotate laterally along with movement of the driving rollers 31A through 34A.

The multiple moving units are two shift blocks 41, a shaft 42 of the upper guide plate 35, a moving motor 45, a belt driving mechanism 46, timing belts 47, pulley gears 48, motor pulleys 49, and racks 50. The two shift blocks 41, the shaft 42, and the moving motor 45 are disposed to the upper guide plate 35, and the belt driving mechanism 46, the timing belts 47, the pulley gears 48, the motor pulleys 49, and the racks 50 are disposed to the lower guide plate 36.

Figure 8:
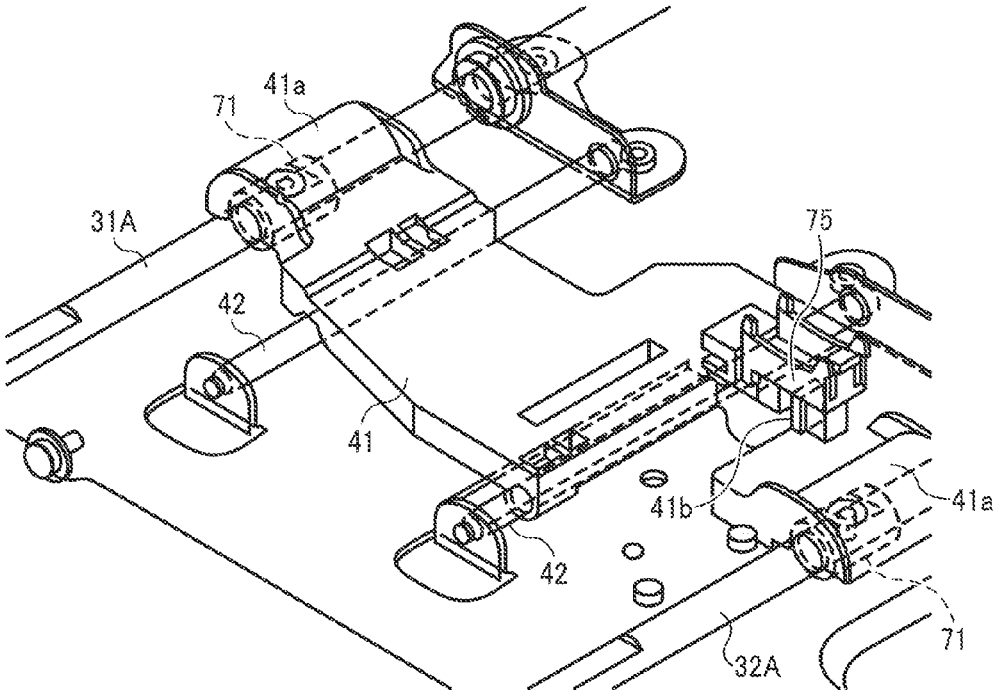
FIG. 8 is an enlarged view illustrating a shift block and neighboring units in the sheet adjusting device.

As illustrated in FIGS. 4 and 8, the two shift blocks 41 functioning as movable plates are attached movably laterally along the shaft 42 of the upper guide plate 35. One of the shaft blocks 41 includes holders 41*a* at both ends thereof. The holders 41*a* hold bushes 71 which are fixed to the shafts 31A1 and 32A1, respectively, or to the shafts 33A1 and 34A1, respectively. According to the above-described configuration, as the shift block 41 moves laterally, the holder 41*a* presses one end of the bush 71 to move the driving rollers 31A and 32A or the driving rollers 33A and 34A along with the shift block 41.

Further, as illustrated in FIG. 5, the lower guide plate 36 includes racks 50 and pulley gears 48. The respective racks 50 are provided for the corresponding shift blocks 41. The pulley gears 48 are rotatably disposed with the upper guide plate 35 and include gears 48*a* and 48*b*. The gears 48*a* mesh with the racks 50. The moving motor 45 is disposed on the upper guide plate 35 and motor pulleys 49 are fixed thereto, as illustrated in FIG. 4. The timing belt 47 is stretched taut around the pulleys 48*b* of the pulley gears 48 and the motor pulleys 49 of the moving motor 45.

In the belt driving mechanism 46 having the above-described configuration, when the moving motor 45 drives, the driving force generated by the moving motor 45 is transmitted to the motor pulleys 49, the timing belt 47, and the pulley gears 48, thereby moving the shift blocks 41 laterally followed by the driving rollers 31A through 34A. In other words, the multiple moving units 41, 42, and 45 through 50 move the driving rollers 31A through 34A laterally.

Further, as illustrated in FIG. 8, a position sensor 75 is disposed on the upper guide plate 35. The position sensor 75 functions as a detector to detect the position of the shift block 41 (and the driving rollers 31A and 32A) laterally. In the present invention, the position sensor 75 is a photosensor including a light emitter and a light receiver and optically detects a projection 41*b* formed on the shift block 41, thereby determining the lateral position of the shift block 41 including the driving rollers 31A and 32A. Accordingly, the shift block 41 including the driving rollers 31A and 32A can be moved to a predetermined lateral position.

It is to be noted that the reason the sheet adjusting device 30 according to the present embodiment includes four driving rollers 31A through 34A movable laterally is to handle sheets of different lengths. Specifically, when a sheet S having a longest length is conveyed, the four pairs of sheet feed rollers 31 through 34 convey the sheet S laterally while interposing the sheet S therebetween for lateral registration adjustment. By contrast, when a sheet S having a shortest length is conveyed, the two pairs of sheet feed rollers 33 and 34 that are disposed downstream in the sheet conveyance direction are used to convey the sheet S laterally while interposing the sheet S therebetween for lateral registration adjustment.

Further, of the four driving rollers 31A through 34A, the two pairs of sheet feed rollers 31 and 32 that are disposed upstream in the sheet conveyance direction are moved by one shift block 41 laterally and the other two pairs of sheet feed rollers 33 and 34 that are disposed downstream in the sheet conveyance direction are moved by the other shift block 41 laterally. This configuration avoids the problem that, if one driving unit drives the four driving rollers 31A through 34A to move laterally concurrently, when a sheet S having a short length is conveyed by the two downstream driving rollers 33A and 34A, a sequential sheet S that has reached the two upstream driving rollers 31A and 32A is also shifted laterally.

Figure 7:
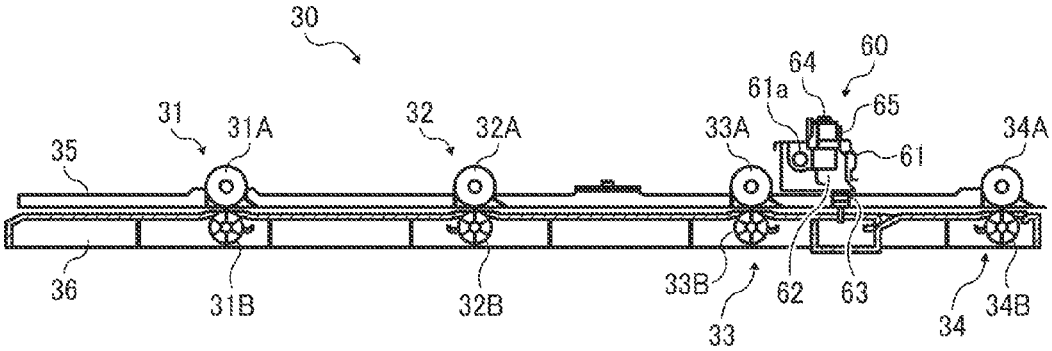
FIG. 7 is a side view illustrating a configuration of the sheet adjusting device.
Figure 9:
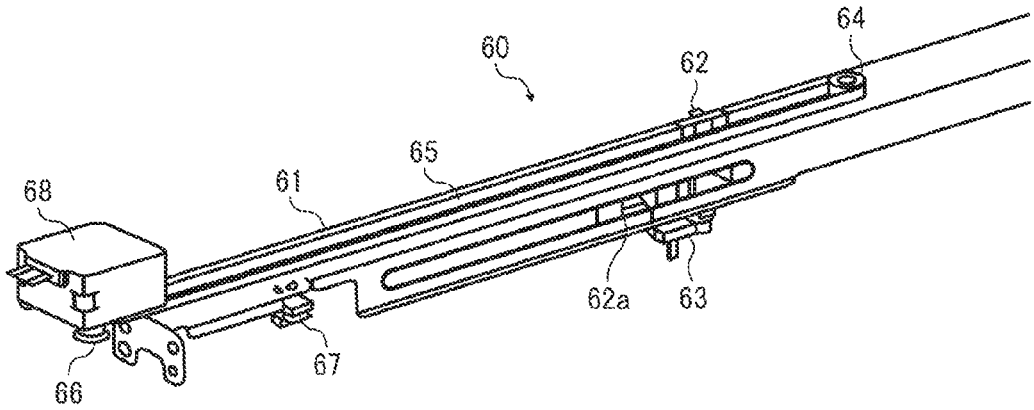
FIG. 9 is an enlarged view illustrating an edge position detector in the sheet adjusting device.

As illustrated in FIGS. 4, 7, and 9, an edge position detector unit 60 is disposed between the two downstream driving rollers 33A and 34A on the upper guide plate 35. The edge position detector unit 60 functions as a detector to detect the position of an edge of the sheet S laterally and is constructed of a case 61, a bracket 62, an edge position sensor 63, a pulley 64, a timing belt 65 and so forth. The edge position sensor 63 is fixed to the bracket 62 that is movable laterally along a shaft 61*a* of the case 61. The timing belt 65 is also fixed to the bracket 62 and is stretched taut around the pulley 64 that is rotatably disposed to the case 61 and a motor pulley 66 of a sensor motor 68 that is fixed on the upper guide plate 35. In this present embodiment, the sensor motor 68 is a stepping motor.

Under the above-described configuration, when the sensor motor 68 is driven, the driving force generated by the sensor motor 68 is transmitted to the motor pulley 66 and the timing belt 65, thereby moving the edge position sensor 63 fixed to the bracket 62 laterally. Further, the case 61 includes a sensor position sensor 67 to detect a projection 62*a* formed on the bracket 62, thereby detecting the lateral position of the edge position sensor 63 on the bracket 62. Thus, the edge position sensor 63 is moved to a predetermined position laterally.

Figure 6:
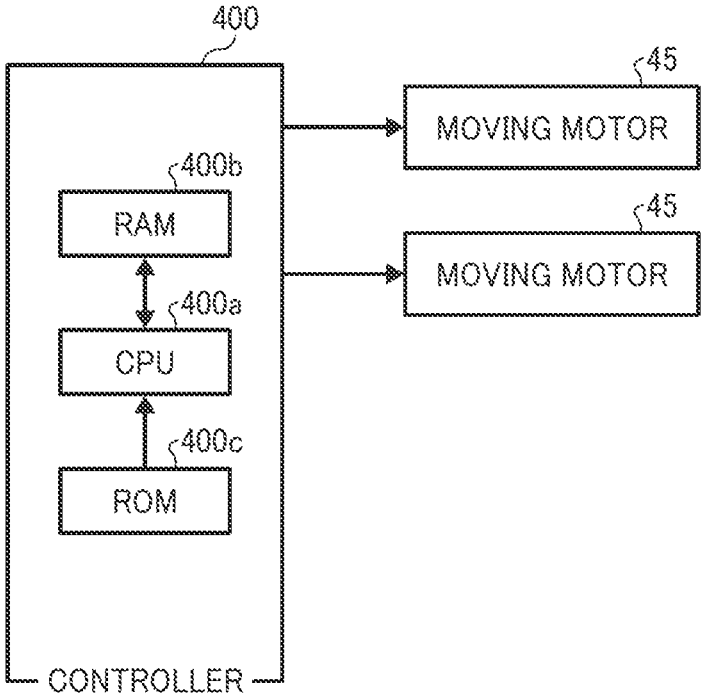
FIG. 6 is a schematic diagram illustrating a configuration of a controller.

It is to be noted that a controller 400 as illustrated in FIG. 6 includes a central processing unit (CPU) 400*a*, a random access memory (RAM) 400*b*, and a read-only memory (ROM) 400*c*, and is connected to the moving motors 45 and so forth. The controller 400 can be included in the image forming apparatus 100, a sheet adjusting unit of a large size that does not include an image forming device, or any suitable unit or device. In this embodiment, the controller 400 is included in the image forming apparatus 100. As illustrated in FIG. 6, the controller 400 is connected to the moving motors 45.

Figure 10:
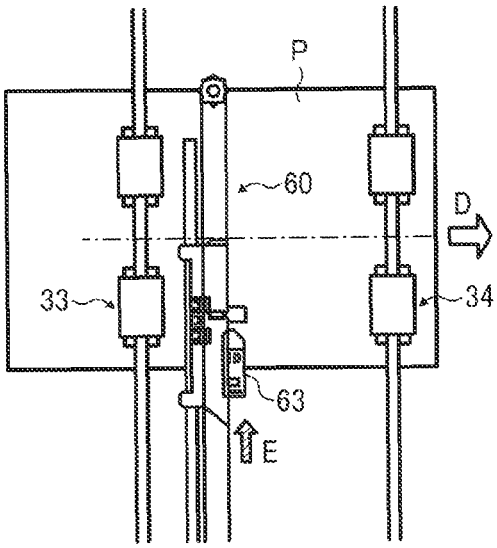
FIG. 10 is a schematic view illustrating a position and operation of pairs of sheet feed rollers and the edge position detector during lateral adjustment.
Figure 11:
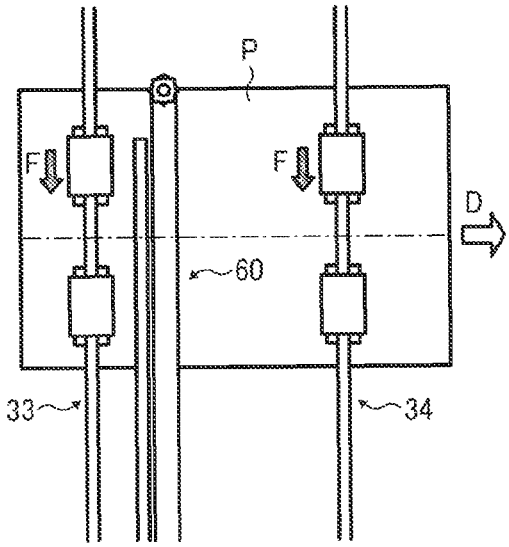
FIG. 11 is a schematic view illustrating position and sequential operation of the pair of sheet feed rollers and the edge position detector during the lateral adjustment of FIG. 9.

With reference to FIGS. 10 and 11, a description is given of lateral registration adjustment performed by detecting the position of the (side) edge of the sheet S. It is to be noted that the following description shows a case in which the sheet S having a short length in the sheet conveyance direction is conveyed and not a case in which the sheet S having a long length in the sheet conveyance direction is conveyed.

As illustrated in FIG. 10, after reaching the sheet adjusting device 30, the sheet S is conveyed between the upper guide plate 35 and the lower guide plate 36 in a sheet conveyance direction D while being interposed between the rotating pairs of sheet feed rollers 31 through 34. After the leading edge of the sheet S has passed the pair of sheet feed rollers 33 and reached the edge position detector unit 60, the edge position sensor 63 standing by at a predetermined position (i.e., a home position) at one side laterally starts to move in a direction E toward the sheet S until it detects the edge of the sheet S. Then, a distance of movement of the edge position sensor 63 is calculated based on the number of pulses that the edge position sensor 63 is moved by the sensor motor 68 from the home position to the edge of the sheet S. Consequently, the calculated distance of movement and a target distance from the home position of the edge position sensor 63 to the edge of the sheet S are compared, and the difference therebetween is determined as an amount for correctly positioning the sheet S or an amount for lateral registration adjustment.

Thereafter, as illustrated in FIG. 11, when the leading edge of the sheet S reaches the pair of sheet feed rollers 34, the moving motor 45 is driven to move the driving rollers 33A and 34A laterally while the downstream pairs of sheet feed rollers 33 and 34 are holding the sheet S therebetween. The driving rollers 33A and 34A are moved by the calculated amount for moving the sheet S, which is the amount for lateral registration adjustment in a direction F in FIG. 11. With this action, the sheet S can be shifted to a target position laterally by performing lateral registration adjustment.

When the driving rollers 33A and 34A are moved laterally while interposing the sheet S therebetween due to movement of the pairs of sheet feed rollers 33 and 34, the driven rollers 33B and 34B pressing the driving rollers 33A and 34A can also be moved laterally. Therefore, the driven rollers 33B and 34B may be moved with movement of the driving rollers 33A and 34A. This may cause the driven rollers 33B and 34B to slip on the sheet S, which moves the driven rollers 33B and 34B by an amount smaller than the distance of movement of the driving rollers 33A and 34A, the sheet S or both. Specifically, if the driven rollers 33B and 34B slip on the sheet S at lateral registration adjustment, the lateral positions of the driven rollers 33B and 34B with respect to the driving rollers 33A and 34A can result in misregistration. Repetition of such misregistration can lead to further misregistration of the lateral positions of the driven rollers 33B and 34B with respect to the driving rollers 33A and 34A, followed by separation of the rollers 33A2 and 34A2 of the driving rollers 33A and 34A and the rollers 33B2 and 34B2 of the driven rollers 33B and 34B, resulting in failure of holding and conveyance of the sheet S between the driving rollers 33A and 34A and the driven rollers 33B and 34B.

In the embodiment, to prevent the above-described failure, relative positions of the driving rollers 33A and 34A and the driven rollers 33B and 34B laterally are adjusted at a predetermined timing.

Specifically, the sheet adjusting device 30 according to the present embodiment further includes stoppers that can contact the driven rollers 31B through 34B to stop movement of the driven rollers 31B through 34B laterally. In this embodiment, stoppers 36*a*1 and 36*a*2 are end portions of each slot 36*a* of the lower guide plate 36 as illustrated in FIGS. 12A, 12B, 13A, and 13B. By contacting the stoppers 36*a*1 and 36*a*2 of the slot 36*a* with both ends of the rollers 31B2 through 34B2 moving laterally, the range of lateral movement of the driven rollers 31B through 34B is limited.

In addition, the multiple moving units move the driving rollers 31A through 34A toward either end laterally to correctly the lateral position of the sheet S held between the driving rollers 31A through 34A and the driven rollers 31B through 34B. The lateral registration adjustment of the sheet S is performed based on a detection result obtained by the edge position detector unit 60 to detect the position of the edge of the sheet S laterally.

Then, immediately after the lateral registration adjustment for the sheet S has been performed, when the sheet S is not held between the driving rollers 31A through 34A and the driven rollers 31B through 34B, the multiple moving units move the driving rollers 31A through 34 in a direction opposite to the direction F until the driven rollers 31B through 34B that is misaligned laterally with respect to the driving rollers 31A through 34A contact the stoppers 36*a*1 and 36*a*2. Specifically, the direction F is an opposite direction to which the driving rollers 31A through 34A are moved to align the lateral position of the sheet S. Thereafter, the multiple moving units continuously move the driving rollers 31A through 34A in the opposite direction to a predetermined position with the driven rollers 31B through 34B contacting the stoppers 36*a*1 and 36*a*2 so as to correctly position the driven rollers 31B through 34B with respect to the driving rollers 31A through 34A laterally.

It is to be noted that the above-described predetermined position is set such that the lateral positions of the driving rollers 31A through 34A with respect to the driven rollers 31B through 34B with the stoppers 36*a*1 and 36*a*2 contacting thereto are at normal positions or the center of the driving rollers 31A through 34A substantially correspond to the center of the driven rollers 31B through 34B laterally.

Specifically, immediately after the multiple moving units move the driving rollers 31A through 34A toward one end laterally for performing the lateral registration adjustment of the sheet S based on the detection result obtained by the edge position detector unit 60, when the sheet S is not held between the driving rollers 31A through 34A and the driven rollers 31B through 34B, the multiple moving units move the driving rollers 31A through 34 in the direction opposite to the direction F until the driven rollers 31B through 34B contact the stoppers 36*a*1 and 36*a*2. Thereafter, the multiple moving units continuously move the driving rollers 31A through 34A in the opposite direction to the predetermined position with the driven rollers 31B through 34B contacting the stoppers 36*a*1 and 36*a*2 so as to correctly position the driven rollers 31B through 34B with respect to the driving rollers 31A through 34A laterally.

By contrast, the controller 400 causes the multiple moving units to move the driving rollers 31A through 34A to the other end thereof laterally for adjusting the position of the sheet S laterally based on the detection result obtained by the edge position detector unit 60. Immediately thereafter, with the sheet S not being interposed between the driving rollers 31A through 34A and the driven rollers 31B through 34B, until the driven rollers 31B through 34B contact the stoppers 36*a*1 and 36*a*2, the controller 400 causes the driving rollers 31A through 34A to move laterally toward the one end. Even after that, with the driven rollers 31B through 34B remaining contacted with the stoppers 36*a*1 and 36*a*2, the controller 400 continuously causes the driving rollers 31A through 34A to move toward the one end of the lateral direction. By so doing, the lateral positions of the driven rollers 31B through 34B with respect to the driving rollers 31A through 34A can be adjusted.

Such control is conducted because the lateral misregistration of the driven rollers 31B through 34B with respect to the driving rollers 31A through 34A causes slippage between the sheet S and the driven rollers 33B and 34B during the lateral registration adjustment of the sheet S laterally and is determined according to a direction of movement of the driving rollers 31A through 34A.

By performing the above-described control, the entire time the multiple moving units moves the driving rollers 31A through 34A can be reduced substantially, compared to when the lateral positions of the driven rollers 31B through 34B with respect to the driving rollers 31A through 34A are corrected or adjusted by moving the driving rollers 31A through 34A to a predetermined position toward the other end laterally thereof after the multiple moving units have moved the driving rollers 31A through 34A to one end laterally.

When a jammed sheet S is removed from an area where the sheet adjusting device 30 conveys the sheet S or immediately after the power of the image forming apparatus 100 is turned on, it is difficult to move the driving rollers 31A through 34A to set in an identical direction.

Because of these different possibilities, in this embodiment, when it is likely that the driving rollers 31A through 34A move laterally without the sheet S interposed between the driving rollers 31A through 34A and the driven rollers 31B through 34B being adjusted by the multiple moving units, the lateral positions of the driven rollers 31B through 34B with respect to the driving rollers 31A through 34A are adjusted by moving the driving rollers 31A through 34A to the predetermined position toward the other end laterally after moving the driving rollers 31A through 34A to the predetermined position toward the one end laterally by the multiple moving units. Specifically, when adjusting the position of the driven rollers 31B through 34B, the driving rollers 31A through 34A are moved to the predetermined position at the one end laterally, which is a side toward the one end 36*a*1 of the slot 36*a*, and are then moved to the predetermined position at the other end laterally, which is a side toward the other end 36*a*2 of the slot 36*a*.

A description is now given of operations of the above-described driven rollers 31B through 34B during the lateral adjustment operation described above, with reference to FIGS. 12A-12C and 13A-13C.

It is to be noted that the figures show the two downstream driven rollers 33B and 34B as an example that the third driven roller 33B is misaligned to one side laterally (as illustrated in upper portions of FIGS. 12A through 12C and 13A through 13C, which is in a direction indicated by arrow G) and the fourth driven roller 34B is misaligned to the other side laterally (as illustrated in lower portions of FIGS. 12A through 12C and 13A through 13C, which is in a direction indicated by arrow H).

As described above, the driven rollers 33B and 34B can be misaligned to different directions, not immediately after the lateral registration amount but when the jammed sheet S is removed from the sheet adjusting device 30 or immediately after the power of the image forming apparatus 100 has been turned on.

Figure 12A:
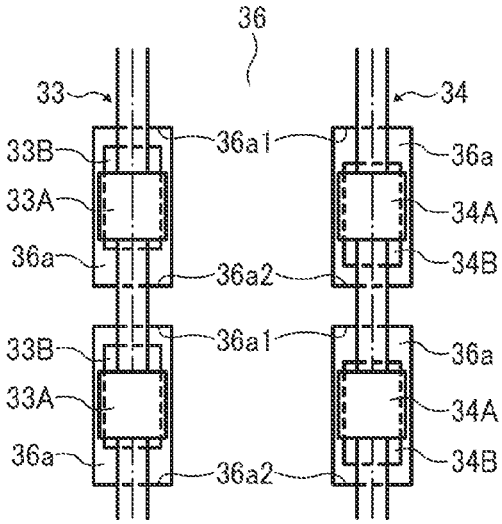
FIGS. 12A through 12C are schematic views illustrating operations of the pair of sheet feed rollers during a lateral adjustment the sheet feed rollers.
Figure 12B:
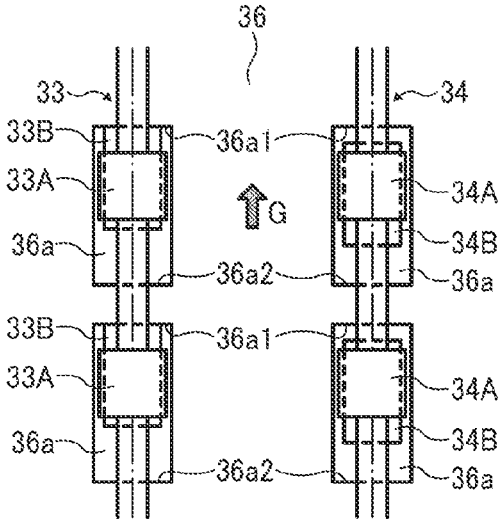

First, when the controller 400 detects that the sheet S is jammed in the sheet adjusting device 30 and removed therefrom or that when the power of the image forming apparatus 100 is turned on, the moving motor 45 is driven to move the driving rollers 33A and 34A to the one side laterally while the downstream pairs of sheet feed rollers 33 and 34 are not holding the sheet S therebetween, as illustrated in FIGS. 12A to 12B.

Figure 12C:
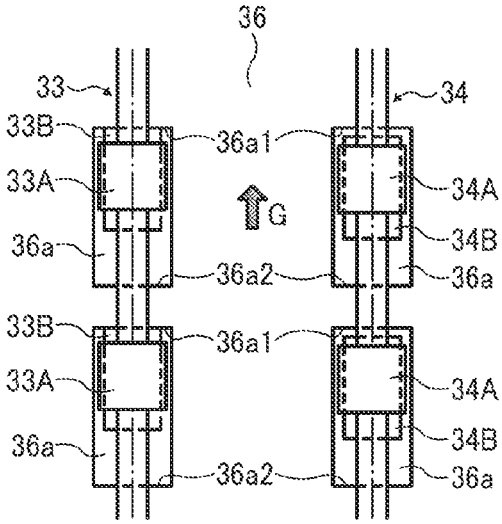

At this time, the driven rollers 33B and 34B move together with the driving rollers 33A and 34A with the positions of the driving rollers 33A and 34A remaining misaligned. Then, as illustrated in FIG. 12B, the rollers of the third driven rollers 33B that is misaligned to the moved position contacts the stopper 36*a*1 at the one end of the slot 36*a*. Then, as illustrated in FIG. 12C, the multiple moving units continuously causes the driving rollers 33A and 34A to further move them to the one side laterally. However, at this time the third driven rollers 33B are in contact with the stoppers 36*a*1, and therefore remain at the positions against the frictional resistance with the driving rollers 33A and the movement thereof is limited. Then, when the driving rollers 33A and 34A are stopped at the predetermined position toward the one side of the lateral direction, the position of the third driven roller 33B with respect to the third driving roller 33A is corrected (FIG. 12C). It is to be noted that the processes of FIGS. 12A through 12C are for positional adjustment of the driven roller that is misaligned to the one side laterally and not for positional adjustment of the fourth driven roller 34B that is misaligned to the other side laterally.

Figure 13A:
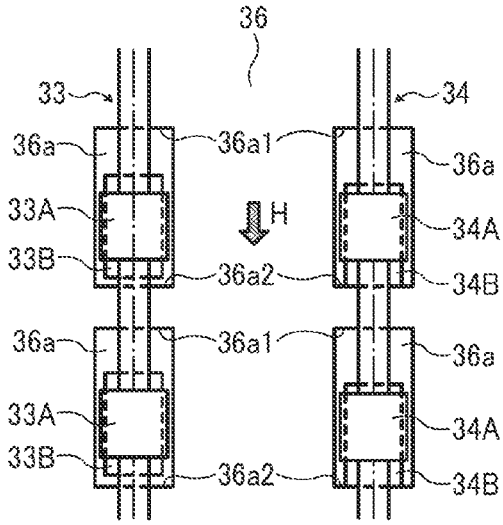
FIGS. 13A through 13C are schematic views illustrating sequential operations of the pair of sheet feed rollers during the lateral adjustment of FIGS. 12A through 12C.

Next, after completion of positional adjustment of the third driven roller 33B, the controller 400 drives the multiple moving units to move the driving rollers 33A and 34A toward the other side laterally, as illustrated from FIG. 12C to FIG. 13A. At this time, the two driven rollers 33B and 34B move together with the driving rollers 33A and 34A while maintaining the relative positions to the driving rollers 33A and 34A. Then, as illustrated in FIG. 13A, the rollers of the fourth driven rollers 34B that were misaligned to the moved side contact the stoppers 36*a*2 which is the other side of the slots 36*a*. Further, as illustrated in FIG. 13B, the multiple moving units continue to move the driving rollers 33A and 34A to the other side laterally. However, at this time the fourth driven rollers 34B are in contact with the stoppers 36*a*1, and therefore remain at the positions against the frictional resistance with the driving rollers 34A and the movement thereof is limited. Then, when the driving rollers 33A and 34A are stopped at the predetermined position toward the other side of the lateral direction, the position of the fourth driven roller 34B with respect to the fourth driving rollers 33A are corrected (FIG. 13C). It is to be noted that the processes of FIGS. 13A through 13C are for positional adjustment of the driven roller that is misaligned to the other side laterally and not for positional adjustment of the third driven rollers 33B that are already corrected to the other side laterally.

As described above, by moving the driving rollers 33A and 34A in different directions, even if the driven rollers 33B and 34B are misaligned in either direction, the positions of the driving rollers 33A and 34A can be adjusted reliably.

Figure 13B:
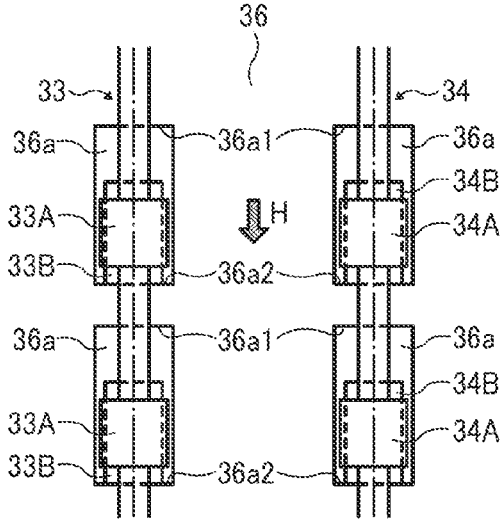
Figure 13C:
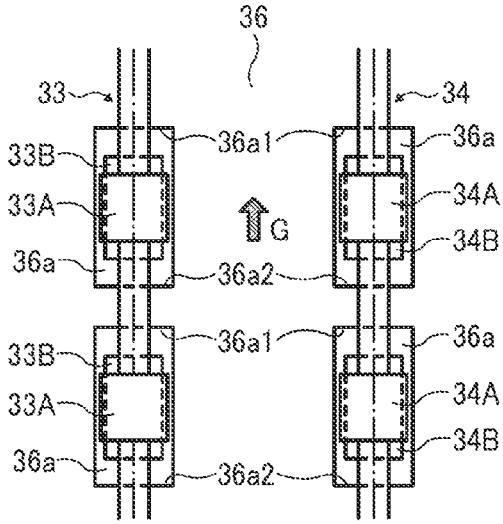

Consequently, as illustrated in FIG. 13C, after completion of the positional adjustment of the driven rollers 33B and 34B, the controller 400 drives the multiple moving units to move the driving rollers 33A and 34A to the one side so as to correctly position the rollers of the driving rollers 33A and 34A and the rollers of the driven rollers 33B and 34B at the center portions of the slots 36*a* laterally, and prepare for a next sheet conveying job.

Next, a description is given of operations of the positional adjustment of the driven rollers 31B through 34B immediately after the lateral registration adjustment, with respect to FIGS. 12A through 12C and FIGS. 13A through 13C.

When the lateral registration adjustment is performed as described above, the direction to which the driven rollers 31B through 34B are misaligned in position is determined to a specific direction according to the direction to which the driving rollers 31A through 34A move. Specifically, the driven rollers 31B through 34B are misaligned to the opposite direction with respect to the direction of movement of the driving rollers 31A through 34A in the lateral registration adjustment. Therefore, by moving the driving rollers 31A through 34A in the opposite direction after the lateral registration adjustment, the positions of the driven rollers 31B through 34B can be adjusted.

Specifically, as illustrated in FIG. 12A with the third pair of sheet feed rollers 33, if the lateral registration adjustment in which the driving rollers 31A through 34A are moved to the one end laterally (the lower portion of FIG. 12A) results in misalignment of the driven rollers 31B through 34B with respect to the driving rollers 31A through 34A to the other end laterally (the upper portion of FIG. 12A), the operation illustrated on the left of the FIG. 13C is performed without performing the operations on the left of FIGS. 13A and 13B, where the driving rollers 33A are moved to the one end, after the movement of the third pair of sheet feed rollers 33 in the order of the left part of FIGS. 12A through 12C.

By contrast, as illustrated in FIG. 12A with the fourth pair of sheet feed rollers 34, if the lateral registration adjustment in which the driving rollers 31A through 34A are moved to the other end laterally (the upper portion of FIG. 12A) results in misalignment of the driven rollers 31B through 34B with respect to the driving rollers 31A through 34A to the one end laterally (the lower direction of 12A), the operation of the third pair of sheet feed rollers 33 illustrated on the right of the FIGS. 12A, 13A, 13B, and 13C is performed in this order without performing the operations on the right of FIGS. 12B and 12C, where the driving rollers 33A are moved to the other end.

It is preferable that the positional adjustment of the driven rollers 31B through 34B after the lateral registration adjustment is performed each time the sheet S passes the sheet adjusting device 30. By performing the above-described positional adjustment each time the lateral registration adjustment is performed, the misregistration of the driven rollers 31B through 34B does not increase or accumulate, thereby reducing the misalignment accurately and reliably.

Further, it is preferable to control the multiple moving units to make the speed of movement of the driving rollers 31A through 34A when the lateral positions of the driven rollers 31B through 34B with respect to the driving rollers 31A through 34A are adjusted, compared to the speed of movement of the driving rollers 31A through 34A when the sheet S that is interposed between the driving rollers 31A through 34A and the driven rollers 31B through 34B is adjusted laterally.

According to the above-described configuration, the positional misregistration of the driven rollers 31B through 34B after the lateral registration adjustment can be performed in a short time, without causing accuracy degradation in the lateral registration adjustment with respect to the sheet S.

As described above, the image forming apparatus 100 according to an embodiment of the present invention includes the pairs of sheet feed rollers 31 through 34 including the driving rollers 31A through 34A and the driven rollers 31B through 34B, respectively, to interpose the sheet S therebetween. Even if the controller 400 causes the multiple moving units to move the driving rollers 31A through 34A laterally and the driven rollers 31B through 34B are rotated with rotation of the driving rollers 31A through 34A, the controller 400 causes the multiple moving units to move the driving rollers 31A through 34A either toward the one end or the other end laterally after the controller 400 has caused the multiple moving units to move the driving rollers 31A through 34A in the one end or the other end laterally. Then, the controller 400 moves the driving rollers 31A through 34A in the opposite direction to the above-described direction of movement, with the driven rollers 31B through 34B in contact with the stoppers 36*a*1 and 36*a*2, and moves the driving rollers 31A through 34A to the predetermined position in the opposite direction. Therefore, the lateral positions of the driven rollers 31B through 34B with respect to the driving rollers 31A through 34A do not shift significantly, thereby adjusting the positions in a short time.

In this embodiment, the sheet adjusting device 30 is disposed adjacent to the upstream side from the pair of registration rollers 18 in the sheet conveyance direction. However, the location of the sheet adjusting device 30 is not limited thereto.

Further, the technique described in this embodiment is applied to the sheet adjusting device 30 that adjusts the position of the sheet S as a recording medium or a transfer sheet on which an image is formed. However, the technique is not limited thereto and can be applied to a sheet adjusting device that adjusts the position of the sheet S as an original document.

Further, the technique described in this embodiment is applied to the sheet adjusting device 30 that is included in the image forming apparatus 100 functioning as an electrophotographic image forming apparatus. However, the technique is not limited thereto and can be applied to a sheet adjusting device included in an image forming apparatus using other technique such as an inkjet image forming apparatus.

The technique described in an embodiment of the present invention can achieve the same effect as that used in the above-described modifications.

Further, this embodiment of the present invention describes the stoppers 36*a*1 and 36*a*2 which are end portions of the slots 36*a* formed on the lower guide plate 36 so that the stoppers 36*a*1 and 36*a*2 can restrict the range of movement of the driven rollers 31B through 34B laterally. However, the configuration of the stoppers is not limited thereto, and any stopper member that contacts the driven rollers 31B through 34 without hindering conveyance of the sheet S can be applied. For example, a stopper member projecting toward a non-conveyance side of the lower guide plate 36 is applicable to the technique used in the embodiment. This modification can provide the same effect as the above-described embodiment.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

an image forming device to form an image on a surface of a sheet of recording media;

a sheet adjusting device positioned upstream from the image forming device to adjust a lateral position of the sheet by moving the sheet in a lateral direction perpendicular to a sheet conveyance direction, the sheet adjusting device comprising:

a driving unit;

a moving unit connected to the driving unit;

a driving roller rotatable by the driving unit and movable laterally by the moving unit;

a driven roller rotatable with rotation of the driving roller while pressing and holding the sheet with the driving roller and movable laterally with movement of the driving roller; and stoppers disposed contactable with both end portions of the driven roller to restrict a range of movement of the driven roller laterally; and a controller operatively connected to the sheet adjusting device to drive the driving unit, the controller causing the moving unit to move the driving roller in one of a first direction toward one axial end of the driving roller and a second direction toward the other axial end of the driving roller for adjusting a position of the sheet interposed between the driving roller and the driven roller laterally, and then adjusting the lateral position of the driven roller with respect to the driving roller by moving the driving roller in a second direction that is opposite to the first direction until the driven roller in misregistration with respect to the driving roller laterally contacts the stoppers with the sheet separated from the driving roller and the driven roller and then by moving the driving roller in the second direction to a predetermined position with the driven roller remaining in contact with the stoppers.

2. The image forming apparatus according to claim 1, wherein the predetermined position is set to a normal lateral position of the driving roller with respect to the driven roller in contact with the stoppers.

3. The image forming apparatus according to claim 1, further comprising a guide member provided to guide the sheet wherein the stoppers are opposed lateral ends of an opening formed in the guide member, wherein a roller portion of the driven roller is exposed therefrom to contact with a roller portion of the driving roller through the opening.

4. The image forming apparatus according to claim 1, further comprising a detector to detect the lateral position of a lateral edge of the sheet, wherein the controller causes the moving unit to move the driving roller in one of the first direction and the second direction based on a detection result obtained by the detector to adjust the lateral position of the sheet held between the driving roller and the driven roller.

5. The image forming apparatus according to claim 1, wherein, when the driving roller moves laterally without lateral positional adjustment of the sheet held between the driving roller and the driven roller, the controller causes the moving unit to move the driving roller in either one of the first direction and the second direction to the predetermined position and then move the driving roller in the other of the first direction and the second direction to adjust the lateral position of the driven roller with respect to the driven roller.

6. The image forming apparatus according to claim 1, wherein the controller causes the moving unit to increase a speed of movement of the driving roller in adjustment of the lateral position of the driven roller with respect to the driving roller compared to a speed of movement of the driving roller in adjustment of the lateral position of the sheet held between the driving roller and the driven roller.

7. A sheet adjusting device, comprising:

a driving unit;

a moving unit connected to the driving unit;

a driving roller rotatable by the driving unit and movable laterally by the moving unit;

a driven roller rotatable with rotation of the driving roller while pressing and holding the sheet with the driving roller and movable laterally with movement of the driving roller;

stoppers disposed contactable with both end portions of the driven roller to restrict a range of movement of the driven roller laterally; and a controller to drive the driving unit, the controller causing the moving unit to move the driving roller in one of a first direction toward one axial end of the driving roller and a second direction toward the other axial end of the driving roller for adjusting a position of the sheet interposed between the driving roller and the driven roller laterally, and then adjusting the lateral position of the driven roller with respect to the driving roller by moving the driving roller in a second direction that is opposite to the first direction until the driven roller in misregistration with respect to the driving roller laterally contacts the stoppers with the sheet separated from the driving roller and the driven roller and then by moving the driving roller in the second direction to a predetermined position with the driven roller remaining in contact with the stoppers.

8. The sheet adjusting device according to claim 7, wherein the predetermined position is set to a normal lateral position of the driving roller with respect to the driven roller in contact with the stoppers.

9. The sheet adjusting device according to claim 7, further comprising a guide member provided to guide the sheet, wherein the stoppers are opposed lateral ends of an opening formed in the guide member, wherein a roller portion of the driven roller is exposed to contact with a roller portion of the driving roller through the opening.

10. The sheet adjusting device according to claim 7, further comprising a detector to detect the lateral position of the an edge of the sheet, wherein the controller causes the moving unit to move the driving roller to one of the first direction and the second direction based on a detection result obtained by the detector to adjust the lateral position of the sheet held between the driving roller and the driven roller.

11. The sheet adjusting device according to claim 7, wherein, when the driving roller moves laterally without lateral positional adjustment of the sheet held between the driving roller and the driven roller, the controller causes the moving unit to move the driving roller in either one of the first direction and the second direction to the predetermined position and then move the driving roller in the other of the first direction and the second direction to adjust the lateral position of the driven roller with respect to the driven roller.

12. The sheet adjusting device according to claim 7, wherein the controller causes the moving unit to increase a speed of movement of the driving roller in adjustment of the lateral position of the driven roller with respect to the driving roller compared to a speed of movement of the driving roller in adjustment of the lateral position of the sheet held between the driving roller and the driven roller.

* * * * *